United States Patent [19]

Farrell et al.

[11] Patent Number: 4,824,015

[45] Date of Patent: Apr. 25, 1989

[54] RAIL BRACE

[75] Inventors: Arthur W. Farrell, Naperville; James A. Remington, Richton Park, both of Ill.

[73] Assignee: ABC Rail Corporation, Chicago, Ill.

[21] Appl. No.: 118,215

[22] Filed: Nov. 6, 1987

[51] Int. Cl.[4] ..... E01B 9/60

[52] U.S. Cl. ..... 238/336; 238/349

[58] Field of Search ..... 238/336, 349, 338, 287, 238/337, 343, 292, 351, 310

[56] References Cited

U.S. PATENT DOCUMENTS

| | | | |
|---|---|---|---|
| 1,275,544 | 8/1918 | Felton | 238/336 |
| 1,420,749 | 6/1922 | Rapp | 238/336 |
| 3,269,655 | 8/1966 | Frey | 238/292 |
| 3,463,394 | 8/1969 | Jones et al. | 238/338 |
| 4,348,151 | 9/1982 | Schumaker | 238/349 |
| 4,405,081 | 9/1983 | Tack | 238/349 |
| 4,463,898 | 8/1984 | Young et al. | 238/310 |
| 4,566,630 | 1/1986 | Keiper, Jr. | 238/292 |
| 4,566,631 | 1/1986 | Brown | 238/349 |
| 4,625,912 | 12/1986 | Fee | 238/349 |

*Primary Examiner*—Johnny D. Cherry

*Assistant Examiner*—Joseph D. Pape

*Attorney, Agent, or Firm*—Thomas S. Baker, Jr.

[57] ABSTRACT

A rail brace assembly for buttressing the head of a rail resting on the top surface of a brace plate by engaging fishing surfaces formed on the head and base of the rail. The assembly includes a rail brace having an upper slanted surface for engaging the head fishing surface, a lower surface for engaging the base fishing surface, a bottom surface adapted to rest upon the brace plate, a front surface for receiving one leg of a resilient fastener and a pair of laterally extending ears. The assembly further includes a shoulder having laterally extending side surfaces and an opening for receiving another leg of the resilient fastener. The ears of the rail brace overlie the laterally extending side surfaces of the support to prevent longitudinal movement of the rail brace. A resilient fastener having one leg adapted to engage the rail brace surface and another leg adapted to be inserted into the shoulder opening acts to apply a vertical downwardly directed force biasing the brace against the brace plate and and a horizontal inwardly directed force biasing the brace against the rail to thereby prevent lateral and rotational movement of the rail brace.

22 Claims, 2 Drawing Sheets

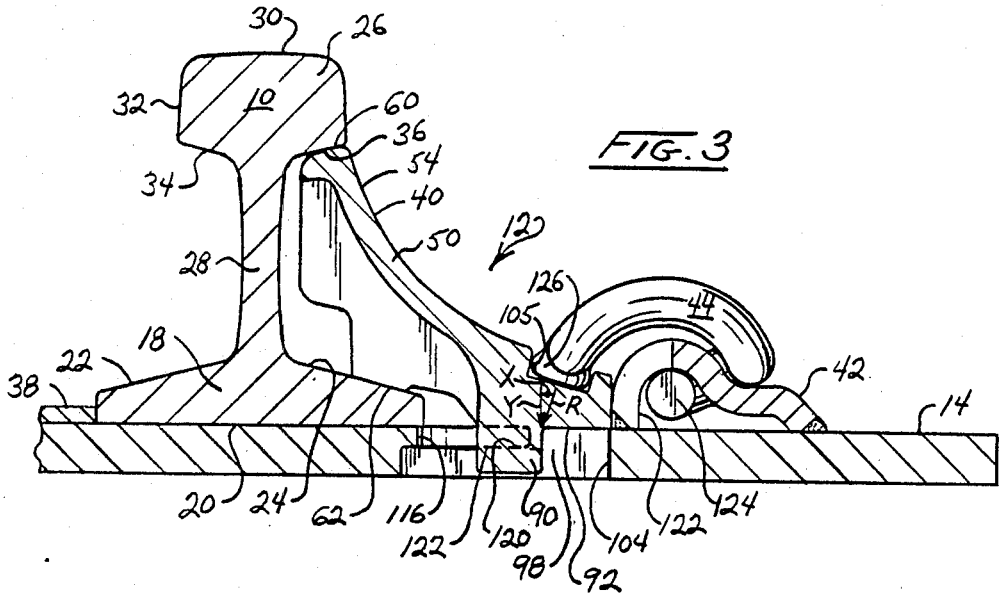
FIG. 3
FIG. 4
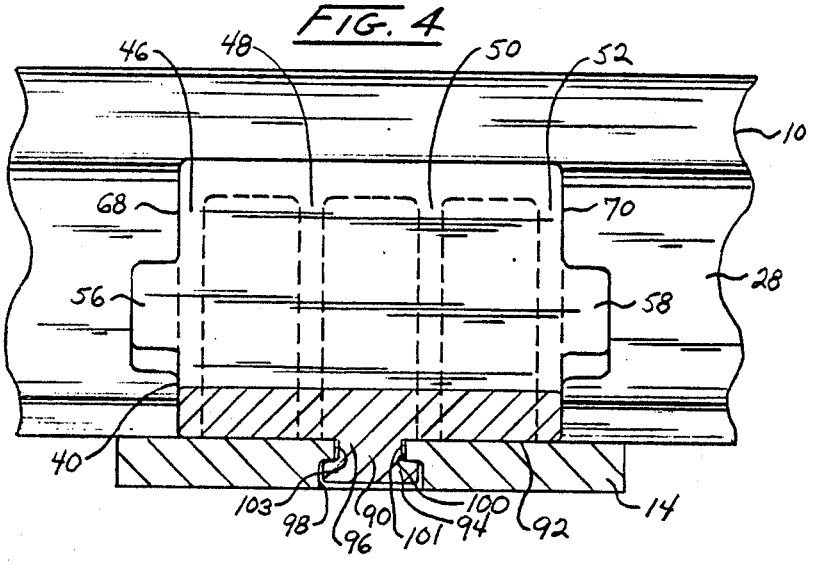

RAIL BRACE

BACKGROUND OF THE INVENTION

Rail braces are utilized to buttress railroad rails against the side thrusts of the rail traffic tending to overturn them. When a rail is overturned, the head of the rail is rotated about its origin to a position in which it is angularly offset with respect to a straight line extending through the vertical axis of the rail. The head of a rail may rotate with respect to the base of the rail because the base is not anchored or affixed to the rail ties. Therefore, the head of the rail which supports the traffic load is free to move. Rotation of the rail head even to a small degree is undesirable because if a lateral load is applied to the head of a rail over a relatively long length of rail, it is possible that the lateral load may cause the entire rail to roll over and ultimately collapse.

A rail brace supports a rail and resists lateral movement of the head of the rail by having an upper surface which bears against a fishing surface formed on the underside of the head of the rail and a lower surface which bears against a fishing surface formed on the top side of the base of the rail on the side of the rail opposite that engaged by the flange of a car or locomotive wheel. Traditionally, some braces have been anchored by being spiked to a wooden tie. However, rail braces anchored in this manner eventually loosen and it has been necessary to periodically tighten the brace so that it firmly engages the base and head of the rail. Where a brace has been spiked to a tie, it becomes necessary to remove the spikes and redrive them in order to retighten the brace. Eventually, the tie must be replaced because it has been "spike killed".

Because of the disadvantages inherent in fixed rail braces, adjustable braces were developed which eliminated the need to respike the brace assembly each time the brace was tightened. In one type of adjustable brace, one side of the base of the brace is set at an angle and this side directly engages a stop on the tie plate set at a similar angle to thereby provide a wedging action of the brace between the rail and the stop. In another type of adjustable brace, a wedge is interposed between the brace and the stop secured to the tie plate. In both of these assemblies the brace must be driven into frictional engagement with the stop or the wedge to firmly secure the brace into abutting contact with the rail. After the wedge or brace in these assemblies has been driven into position, the brace may be secured by bolts, nuts or lag screws. In some instances, the wedge member has been secured by having a cover plate that is secured by bolts to the tie plate engage the wedge member or the wedge member and the brace to thereby secure these elements. One problem which has been experienced where bolts, nuts or lag screws are utilized to secure adjustable braces resides in the fact that it has been found necessary to periodically inspect the braces to determine if they have remained in firm contact with the rail. Where looseness of the brace has been observed, trackwork maintenance personnel must loosen the fasteners, drive the wedge or brace into firm engagement with the rail and thereafter resecure the fasteners. Such inspection and tightening of braces by track personnel has greatly increased the cost of maintaining rail lines. Additionally, such maintenance practices necessitate the use of relatively skilled maintenance personnel who must be able to determine the proper degree of tightness for a rail brace.

Because it has been found time consuming and expensive from a maintenance standpoint to utilize bolts or lag screws to secure rail braces, the railroad industry has begun to utilize elastic fasteners such as spring clips to bias adjustable rail braces against stock rails. In one type of adjustable brace assembly utilizing an elastic fastener, one side of the base of the brace is set at an angle with respect to the surfaces on the rail which engage the brace and the angled side of the base engages a stop mounted on the tie plate having a complimentary angled face to thereby provide a frictional wedging action for urging the brace against the rail. In this assembly the elastic fastener biases a cover plate downwardly against a flat surface formed on the top of the brace to prevent vertical and horizontal movement of the brace. The surface on the brace may be corrugated and engage a similarly corrugated surface formed on the bottom of the cover plate to further inhibit longitudinal movement of the brace. In this assembly the axis of the elastic fastener has been made nonparallel to the surfaces of the rail brace which engage the stock rail. One problem with having the axis of the fastener nonparallel to that of the rail is that automatic equipment utilized to install such fasteners normally only can install these fasteners if the axes of the fasteners are parallel to that of the rail. If the axes are not parallel to the rail, the fasteners must be installed manually.

It has been found that where an elastic fastener has been utilized to clamp or lock a cover plate against a horizontal surface on a rail brace, vibration and movement of the rail may cause the rail brace to loosen. This occurs because as the traffic passes over the rail, the rail and the brace may move vertically downwardly and momentarily move out of contact with the cover plate. As a result, the top surface of the brace tends to separate from the cover plate and the brace and cover plate are no longer locked together. Over a period of time, the rail brace may move horizontally with respect to the cover plate and move away from the rail.

Recently, legislation has been enacted deregulating the rates set by railroads for transporting freight. Accordingly, this has forced the railroads to become more competitive with trucks and with each other. As a result, railroads have been forced to discontinue using duplicate lines of track. This has resulted in a reduction of the railroad labor force through early retirements and normal attrition. Resultantly, the remaining labor force has become less experienced and less skilled than the railroad maintenance force of the past. Thus, railroad trackwork component suppliers have been encouraged to provide products having fewer parts, easier installation, and less maintenance.

Accordingly, it has been found desirable to provide a rail brace that has fewer parts, that may be retained in position by an elastic fastener, that can be installed with a minimum of effort and knowledge by inexperienced workmen and which requires no maintenance.

SUMMARY OF THE INVENTION

The subject invention relates to a rail brace assembly for buttressing the head of a rail resting on the top surface of a brace plate by engaging fishing surfaces formed on the head and base of the rail. The assembly includes a rail brace having an upper slanted surface for engaging the head fishing surface, a lower surface for engaging the base fishing surface, a bottom surface adapted to rest upon the brace plate, a front surface for receiving one end of a resilient fastener and a pair of laterally extending ears. The assembly further includes a shoulder having laterally extending side surfaces and an opening for receiving another end the resilient fastener. The rail brace ears overlie the laterally extending side surfaces of the shoulder to prevent longitudinal movement of the rail brace. A resilient fastener having one end adapted to engage the rail brace surface and another end adapted to be inserted into the shoulder opening acts to apply a vertical downwardly directed force biasing the brace against the brace plate and a horizontal inwardly directed force biasing the brace against the rail to thereby prevent lateral and rotational movement of the rail brace.

The invention further includes a rail brace for buttressing the head of a rail resting on the top surface of a brace plate by engaging fishing surfaces formed on the head and base of the rail and adapted to be restrained laterally by a resilient clip mounted in a shoulder. The rail brace includes an upper slanted surface for engaging the fishing surface, a lower slanted surface for engaging the base fishing surface, a bottom surface adapted to rest upon a brace plate, a front surface facing away from said slanted upper surface, a longitudinally extending groove formed in the front surface adapted to receive a portion of a resilient fastener and a pair of laterally extending ears which define a slot therebetween adapted to overlie a shoulder.

The invention also includes a rail brace support for anchoring a resilient fastener including a pair of laterally extending side surfaces which define two ends of the support, a longitudinally extending opening adapted to receive a portion of a resilient fastener and opening into each of the side surfaces, a pair of laterally extending legs in which the outer surfaces of the legs are defined by the laterally extending side surfaces and a slot defined between the legs.

BRIEF DESCRIPTION OF THE DRAWINGS

FIG. 3 is a transverse sectional view along line 3—3 of FIG. 2; and

FIG. 4 is a sectional view along line 4—4 of FIG. 2.

DESCRIPTION OF THE PREFERRED EMBODIMENT

Figure 1:
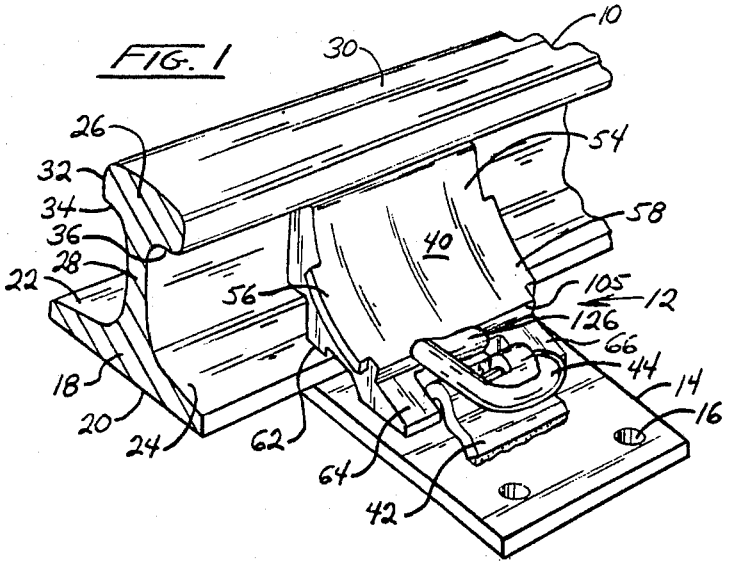
FIG. 1 is a perspective view of the rail brace assembly of the instant invention.

Turning to FIG. 1 of the drawings, a stock rail 10 and a rail brace assembly 12 are shown seated upon a brace plate 14 having holes 16 for receiving spikes or bolts used to fasten the plate 14 to a wood, steel, concrete or other type of railroad tie, not shown. Rail 10 includes a generally laterally extending base 18 having a bottom surface 20, which rests upon brace plate 14 and a pair of inclined top surfaces 22 and 24 which commonly are referred to as base fishing surfaces. The rail 10 also includes a head 26 which is connected to base 18 by a vertical web 28 and which includes a top surface 30 that engages the treads of railroad car and locomotive wheels, a vertical surface 32 that contacts the flanges of railroad car and locomotive wheels and a pair of angled underside surfaces 34 and 36 that commonly are referred to as head fishing surfaces.

As mentioned previously, the rail brace assembly 12 of the present invention functions to buttress the tail 10 to prevent the head 26 of the rail 10 from rolling or becoming angularly displaced with respect to the vertical axis of the rail 10 when rail traffic passes thereover. Additionally, the brace assembly 12 functions to clamp the base 18 of rail 10 against a welded riser 38 applied to the top surface of brace plate 14 to assist in maintaining the gauge of the track, as may be seen by referring to FIG. 3. To accomplish this, the rail brace assembly 12 buttresses the side of the rail 10 opposite that which engages the flanges of the railroad car wheels. Rail brace assembly 12 includes a unitary brace 40 which engages the base and head fishing surfaces 24 and 36 respectively on rail 10, a shoulder 42 which cooperates with brace 40 to prevent longitudinal movement of the brace 40 and an elastic clip 44 which engages brace 40 and shoulder 42 to resist lateral movement and clockwise rotation of brace 40 as will be discussed in detail hereinafter.

Figure 2:
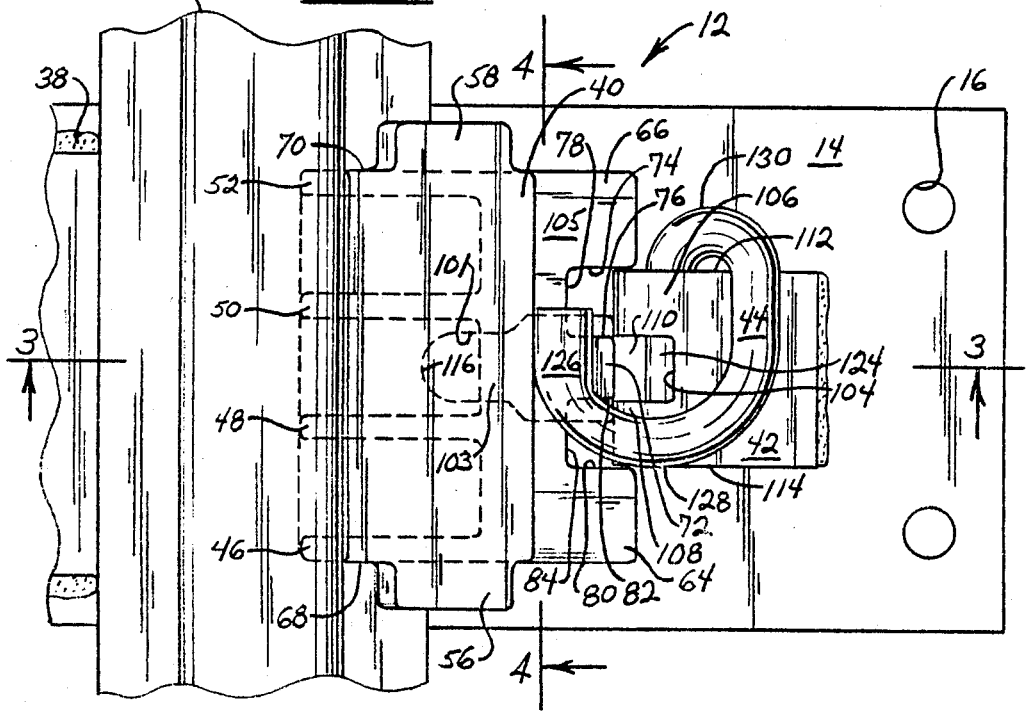
FIG. 2 is a top view of the subject rail brace assembly.

Preferably, brace 40 is constructed as a unitary casting having four equally spaced vertical support ribs 46, 48, 50 and 52, a smooth concave front surface 54 and a pair of handling tabs 56 and 58 projecting longitudinally from each end 68 and 70 of surface 54. Brace 40 further includes a slanted upper surface 60 which intersects the top of front surface 54 and which engages the head fishing surface 36 on rail 10 when properly installed. A slanted lower surface 62 which engages the base fishing surface 24 on rail 10 is formed on the back side of brace 40 and extends in a generally longitudinal or horizontal direction along the bottom surfaces of the ribs 46 through 52. Brace 40 also includes a pair of outer ears 64 and 66 which are located adjacent to the ends 68 and 70 of brace 40 and which project laterally outwardly and away from the rail 10 and from slanted surfaces 54 as illustrated in FIG. 2. A smaller centrally positioned ear 72 is formed on brace 40 intermediate outer ears 64 and 66. This ear projects laterally outwardly away from rail 10 in a manner similar to ears 64 and 66 but projects a shorter distance. The inner side 74 of outer ear 66 and one side 76 of center ear 72 define two sides of a slot 78 formed in brace 40 between those ears. Similarly, the inner side 80 of outer ear 64 and the other side 82 of center ear 72 define two sides of a slot 84 defined between those ears.

Turning to FIG. 3, it may be seen that a lug 90 projects downwardly from the central portion of the bottom surface 92 of brace 40 and through an opening 98 partially defined by a back wall 104 formed in brace plate 14. It may be observed that the lug 90 has a T-shaped cross section such that the head portion 94 of lug 90 has a wider cross sectional area than does the body portion 96 that connects the head portion 94 to the bottom surface 92 of brace 40. The head portion 94 of a lug 90 includes a top surface 120. When brace 40 has been moved against rail 10 the body portion 96 of lug 90 is received within a slot 100 defined by walls 101 and 103 formed in plate 14 and lug 90 is moved toward the back surface 116 of slot 100. Lug 90 is captured within the slot 100 since the head portion 94 is wider than the distance between the walls 101 and 103. Thus, it may be apparent that brace 40 cannot be lifted vertically upwardly from brace plate 14 when in the installed position depicted in FIGS. 1-4 as top surface 120 will engage the bottom surface of the brace 14. The opening 98 and the slot 100 formed in brace plate 14 also may be observed by referring to FIG. 2.

Looking again to FIGS. 1 and 2, a longitudinal groove 105 may be discerned in the lower portion of the concave front surface 54 of brace 40. This groove 105 receives one end of the elastic clip 44 to clamp the brace 40 in position as will be more fully explained below.

Shoulder 42, which cooperates with brace 40 to form rail brace assembly 12 maybe seen best by referring to FIG. 2. Shoulder 42 preferably is welded or otherwise rigidly affixed to brace plate 14 and includes a pair of laterally inwardly extending legs 106 and 108 which define a central slot 110 therebetween for receiving the center ear 72 of the brace 40. A wall 112 defines the outer side of leg 106 and a wall 114 defines the outer surface of leg 108. From the plan view of the rail brace assembly 12 depicted in FIG. 2, it may be noted that the inner side 74 of outer ear 66 and the inner side 80 of outer ear 64 of brace 40 overlie the ends of walls 112 and 114 defining the outer surfaces of legs 106 and 108 respectively and that the legs 106 and 108 may be received with the brace slots 78 and 84. Consequently longitudinal movement of brace 40, i.e. movement parallel to rail 10 is prevented. It should be observed that the center ear 72 of brace 40 fits within the width of slot 110 on shoulder 42 but extends only a short distance into the slot and that the opening 98 in brace plate 14 may be accessed through the slot 110. Additionally, it may be seen that the rail brace 40 may be moved to the right of the installed position depicted in FIG. 2 such that the shoulder legs 106 and 108 are received within the slots 78 and 84 defined in brace 40 on opposite sides of center ear 72. In this position the lug 90 projecting downwardly from the bottom surface 92 of brace 40 may be passed through the opening 98 defined in brace plate 14 for installation or removal of the brace 40.

As mentioned previously, when brace 40 has been moved to the installed position depicted in FIGS. 1–4, the slanted upper and lower surfaces 60 and 62 on brace 40 engage the fishing surfaces 34 and 24 formed on rail 10 and lug 90 on the bottom of brace 40 is captured within slot 100 formed in switch brace plate 14. From FIG. 4, it becomes apparent that the cooperation of lug 90 with slot 100 also acts to prevent longitudinal movement of brace 40.

When a railroad car or locomotive wheel moves over rail 10, a lateral component of car wheel force acts against the left-hand vertical surface 32 of rail 10 which tends to pivot the rail about its lower right-hand edge as the rail 10 is viewed in FIG. 3. To some degree this rotation will be resisted by the welded riser 38 as well as by the brace 40. The force applied to rail 10 tending to pivot the rail also acts to cause the brace 40 to tend to rotate clockwise about the extreme right-hand edge of the ears 64 and 66 where they engage the brace plate 14. When this rotational movement occurs, the lug 90 moves toward the back surface 116 of slot 100 and the head portion 94 of the lug moves upwardly such that the top surface 120 of lug 90 locks against the bottom surface 122 of brace plate 14 adjacent walls 101 and 103 to thereby resist further rotational movement of the brace 40 and to ensure that the brace remains in firm contact with the rail. Consequently, it should be apparent that although the T-shaped lug 90 cooperates with the slot 100 to prevent longitudinal movement of the brace 40, such cooperation also acts to prevent clockwise rotational movement of the brace 40.

The elastic clip or fastener 44 which constitutes the third element of the rail brace assembly 12 acts to prevent lateral movement of brace 40 with respect to rail 10 and to assist in resisting clockwise rotational movement of the brace 40 as will now be described. Again turning to FIG. 3, it may be observed that shoulder 42 includes a longitudinally extending opening 122 which extends parallel to the rail 10 and which receives a straight leg 124 formed on one end of elastic clip 44. A straight leg 126 formed at the opposite end of clip 44 rests within the groove 105 defined within the front surface 54 of brace 40. In this position, elastic clip 44 acts to apply a generally downwardly directed force to brace 40 as represented by a resultant force vector "R". Resultant force vector "R" may be resolved into a horizontal component of force depicted by the vector labeled "X" and into a vertical component of force depicted by the vector labeled "Y". The horizontal component of the force applied by resilient clip 44 acts to bias the brace 40 laterally against the fishing surfaces 24 and 26 formed on the rail 10 whereas the "Y" component of this force acts in a vertically downwardly direction which tends to pivot brace 40 counter-clockwise about the outer edges of ears 64 and 66 to thereby resist the clockwise rotational tendency imparted by the passage of railroad car and locomotive wheels over the rail 10.

From the above it may be discerned that the rail brace assembly 12 includes only two principle components, these being the brace 40 and the shoulder 42, and a resilient fastener 44 which acts to secure the brace 40 in position. The installation and removal of the rail brace 40 may be accomplished by relatively unskilled trackwork personnel as the components can be installed only one way and such installation has been made extremely simple. Because the rail brace assembly 12 has been illustrated in the assembled position in FIGS. 1–4, removal of the rail brace 40 will be described initially. Thereafter installation of the brace 40 will be described.

Turning to FIG. 2, in order for brace 40 to be removed from installation, resilient clip 44 must be driven out of engagement with shoulder 42 and brace 40. This may be accomplished simply by pounding the upper curved portion 128 of the clip 44 with a sledgehammer to drive leg 124 out of shoulder opening 122. Thereafter, brace 40 is moved to the right such that shoulder legs 106 and 108 are received within the slots 78 and 84 formed in brace 40 and lug 90 engages the rear wall 104 of opening 98. In this position brace 40 may be lifted vertically upwardly out of engagement with shoulder 42 and rail 10.

Installation of rail brace 40 is simply the reverse of the removal process. To install brace 40, the center ear 72 is aligned with the centrally located slot 110 in shoulder 42 and the brace 40 is moved vertically downwardly such that the lug 90 passes through the opening 98 formed in switch brace plate 14. As this occurs, the legs 106 and 108 formed on shoulder 42 enter the slots 78 and 80 formed in brace 40. After the bottom surface 92 of brace 40 rests against the top surface of brace plate 14 the brace 40 is moved towards the rail 10. As this occurs, the T-shaped lug 90 enters the slot 100 and the slanted brace surfaces 60 and 62 engage the rail fishing surfaces 36 and 24 as described above. Thereafter, the leg 124 of resilient clip 144 is aligned with the opening 122 in shoulder 42 and the clip is driven home by pounding on lower curved portion 130 such that leg 124 occupies opening 122 and leg 126 rests within groove 105.

Although in the preferred embodiment rail brace 40 has been described as including ears and a lug to resist longitudinal movement thereof, it is possible that in some applications of the subject rail brace assembly, a brace may be utilized having two ears and no downwardly projecting lug or alternatively a downwardly projecting lug and no ears.

From the above it may be seen that the rail brace assembly of the present invention consists of only two major parts and that installation and removal of the rail brace of the subject invention is a relatively simple process which may be accomplished by relatively unskilled trackwork personnel.

Since certain changes may be made in the above-described system and apparatus without departing from the scope of the invention hearin involved, it is intended that all matter contained in the description or shown in the accompanying drawings shall be interpreted as illustrative and not in a limiting sense.

We claim:

1. A rail brace assembly for buttressing the head of a rail resting on the top surface of a brace plate by engaging fishing surfaces formed on the head and base of the rail which comprises:

a rail brace having an upper slanted surface for engaging the head fishing surface, a lower surface for engaging the base fishing surface, a bottom surface adapted to rest upon said brace plate, a front surface for receiving one leg of a resilient fastener, and a pair of laterally extending ears;

a shoulder having laterally extending side surfaces and an opening for receiving another leg of said resilient fastener;

wherein said brace ears overlie said laterally extending side surfaces to prevent longitudinal movement of said rail brace;

a resilient fastener having one leg adapted to engage said rail brace surface and another leg adapted to be inserted into said shoulder opening acting to apply a vertical downwardly directed force biasing said brace against said brace plate and a horizontal inwardly directed force biasing said brace against said rail to thereby prevent lateral and rotational movement of said rail brace.

2. The rail brace assembly of claim 1 which further comprises:

an integral lug formed on the bottom surface of said rail brace;

an opening defined in said brace plate for receiving said lug; and wherein said lug is captured within said opening when said rail brace upper and lower surfaces engage said head and base fishing surfaces.

3. The rail brace assembly of claim 1 in which:

said rail brace includes a longitudinally extending groove which defines said fastener receiving surface.

4. The rail brace assembly of claim 1 in which:

said rail brace includes a pair of handling tabs which project longitudinally one from each side of said front surface.

5. A rail brace assembly for buttressing the head of a rail resting on the top surface of a brace plate by engaging fishing surfaces formed on the head and base of the rail which comprises:

a rail brace having an upper slanted surface for engaging the head fishing surface, a lower surface for engaging the base fishing surface, a bottom surface adapted to rest upon said brace plate, and a front surface for receiving one leg of a resilient fastener;

a shoulder having an opening for receiving another leg of a resilient fastener;

an integral lug formed on the bottom surface of said rail brace;

an opening defined in said brace plate for receiving sail lug; and wherein said lug is captured within said opening when said rail brace upper and lower surfaces engage said head and base fishing surfaces to thereby prevent longitudinal movement of said rail brace; and a resilient fastener having one leg adapted to engage said rail brace surface and another leg adapted to be inserted into said shoulder opening acting to apply a vertical downwardly directed force biasing said brace against said brace plate and a horizontal inwardly directed force biasing said brace against said rail to thereby prevent lateral and rotational movement of said rail brace.

6. The rail brace assembly of claim 5 in which:

said rail brace further comprises a pair of laterally extending ears;

said shoulder further comprises laterally extending side surfaces; and wherein said rail brace ears overlie said laterally extending side surfaces to resist longitudinal movement of said rail brace.

7. The rail brace assembly of claim 5 in which:

said rail brace further comprises a pair of handling tabs which project longitudinally one from each end of said front surface.

8. A rail brace for buttressing the head of a rail resting on the top surface of a brace plate by engaging fishing surfaces formed on the head and base of the rail and adapted to be restrained laterally by a resilient clip mounted in a shoulder comprising:

an upper slanted surface for engaging the head fishing surface;

a lower slanted surface for engaging the base fishing surface;

a bottom surface adapted to rest upon a brace plate;

a front surface facing away from said upper slanted surface;

a longitudinally extending groove formed in said front surface adapted to receive a portion of a resilient fastener; and a pair of laterally extending ears which define a slot therebetween adapted to overlie said shoulder.

9. The rail brace of claim 8 in which:

a downwardly projecting lug is affixed to said bottom surface.

10. The rail brace of claim 9 in which:

said lug has a T-shaped cross sectional area.

11. The rail brace of claim 8 in which:

a pair of longitudinally projecting handling tabs are affixed one to each end of said front surface.

12. The rail brace claim 8 in which:

a laterally projecting central ear is affixed to said brace intermediate each of said pair of laterally extending ears; and wherein a slot is defined between said central ear and each of said pair of laterally extending ears.

13. The rail brace of claim 12 in which:

each of said pair of laterally extending ears project from the front surface of said brace a greater distance that said central ear.

14. A rail brace support for anchoring a resilient fastener comprising:

a pair of laterally extending side surfaces which define two ends of said support;

a longitudinally extending opening adapted to receive a portion of a resilient fastener and opening into each of said side surfaces;

a pair of laterally extending legs in which the outer surfaces of said legs are defined by said laterally extending side surfaces; and wherein said legs define a slot therebetween.

15. A rail brace assembly for buttressing the head of a rail resting on the top surface of a brace plate by engaging fishing surfaces formed on the head and base of the rail which comprises:

a rail brace having an upper slanted surface for engaging the head fishing surface, a lower surface for engaging the base plate, a front surface for receiving one leg of a resilient fastener, a lug formed on said bottom surface and a pair of laterally extending ears;

an opening defined in said brace plate for receiving said lug and said lug is captured within said opening when said rail brace upper and lower surfaces engage said head and base fishing surfaces;

a shoulder having laterally extending side surfaces, a pair of laterally inwardly extending legs the outer edges of which are defined by said laterally extending side surfaces and an opening for receiving another leg of said resilient fastener;

wherein said inwardly extending legs define a slot therebetween and said opening in said brace plate is aligned with said slot;

wherein said brace ears overlie said laterally extending side surfaces to prevent longitudinal movement of said rail brace; and a resilient fastener having one leg adapted to engage said rail brace surface and another leg adapted to be inserted into said shoulder opening acting to apply a vertical downwardly directed force biasing said brace against said brace plate and a horizontal inwardly directed force biasing said brace against said rail to thereby prevent lateral and rotational movement of said rail brace.

16. A rail brace for buttressing the head of a rail upon the top surface of a brace plate by engaging fishing surfaces formed on the head and base of the rail and adapted to be restrained laterally by a resilient clip mounted in a shoulder comprising:

a slanted surface for engaging a head fishing surface;

a lower surface for engaging a base fishing surface;

a bottom surface adapted to rest upon a brace plate;

a downwardly projecting lug means formed on said bottom surface adapted to project through an opening in said brace plate to resist longitudinal movement thereof;

a front surface facing away from said slanted upper surface; and a longitudinally extending flat surface means formed in said front surface adapted to receive a portion of a resilient fastener.

17. The rail brace claim 16 in which:

said lug has a T-shaped cross sectional area.

18. A rail brace assembly for buttressing the head of a rail resting on the top surface of a brace plate by engaging fishing surfaces formed on the head and base of the rail which comprises:

a rail brace having an upper slanted surface for engaging the head fishing surface, a lower surface for engaging the base fishing surface, a bottom surface adapted to rest upon said brace plate, a front surface for receiving one leg of a resilient fastener, and a pair of laterally extending ears;

a shoulder having laterally extending side surfaces and an opening for receiving another leg of said resilient fastener;

wherein said brace ears overlie said laterally extending side surfaces to prevent longitudinal movement of said rail brace;

a resilient fastener having one leg adapted to engage said rail brace surface and another leg adapted to be inserted into said shoulder opening acting to apply a vertical downwardly directed force biasing said brace against said brace plate and a horizontal inwardly directed force biasing said brace against said rail to thereby prevent lateral and rotational movement of said rail brace;

a lug formed on the bottom surface of said rail brace;

an opening defined in said brace plate for receiving said lug;

wherein said lug is captured with said opening when said rail brace upper and lower surfaces engage said head and base fishing surfaces; and said shoulder includes a pair of laterally inwardly extending legs the outer edges of which are defined by said laterally extending side surfaces such that said brace ears overlie said legs.

19. The rail brace assembly of claim 18 in which:

said brace includes a central ear spaced from said pair of laterally extending ears to define a slot between each of said pair of laterally extending ears and said central ear; and wherein each of said slots is adapted to receive one of said pair of inwardly extending legs on said shoulder.

20. The rail brace assembly of claim 18 in which:

said inwardly extending legs define a central slot therebetween; and wherein said opening in said brace plate is aligned with said central slot.

21. A rail brace for buttressing the head of a rail resting on the top surface of a brace plate by engaging fishing surfaces formed on the head and base of the rail and adapted to be restrained laterally by a resilient clip mounted in a shoulder comprising:

an upper slanted surface for engaging the head fishing surface;

a lower slanted surface for engaging the base fishing surface;

a bottom surface adapted to rest upon a brace plate;

a front surface facing away from said upper slanted surface;

a longitudinally extending groove formed in said front surface adapted to receive a portion of a resilient fastener;

a pair of laterally extending ears which define a slot therebetween adapted to overlie said shoulder;

a laterally projecting central ear affixed to said brace intermediate each of said pair of laterally extending ears; and wherein a slot is defined between said central ear and each of said pair of laterally extending ears.

22. The rail brace of claim 21 in which:

each of said pair of laterally extending ears project from the front surface of said brace a greater distance than said central ear.

* * * * *